US006016873A

United States Patent [19]

Hsu et al.

[11] Patent Number: 6,016,873

[45] **Date of Patent: *Jan. 25, 2000**

[54] HYDROLOGIC CELLS FOR THE EXPLOITATION OF HYDROCARBONS FROM CARBONACEOUS FORMATIONS

[75] Inventors: Kenneth J. Hsu; Peter Hsu, both of Zurich, Switzerland

[73] Assignee: Tarim Associates for Scientific Mineral and Oil Exploration AG, Zurich, Switzerland

[ * ] Notice: This patent is subject to a terminal disclaimer.

[21] Appl. No.: 09/041,503

[22] Filed: Mar. 12, 1998

[51] Int. Cl.[7] ..... E21B 43/24

[52] U.S. Cl. ..... 166/402; 166/272.2; 166/272.3; 166/272.7

[58] Field of Search ..... 166/402, 272.3, 166/272.2, 272.7, 271

[56] References Cited

U.S. PATENT DOCUMENTS

| | | | |
|---|---|---|---|
| 4,456,065 | 6/1984 | Heim et al. | 166/272.3 |
| 4,627,493 | 12/1986 | Alameddine et al. | 166/272.3 |
| 4,635,720 | 1/1987 | Chew | 166/272.3 |
| 4,696,345 | 9/1987 | Hsuch | 166/272.3 |
| 5,103,907 | 4/1992 | Shu | 166/272.3 |
| 5,261,490 | 11/1993 | Ebinuma | 166/402 |
| 5,860,475 | 1/1999 | Ejiogu et al. | 166/272.3 |
| 5,868,202 | 2/1999 | Hsu | 166/261 |

*Primary Examiner*—William Neuder
*Attorney, Agent, or Firm*—Helfgott & Karas, P.C.

[57] ABSTRACT

Fluid and/or heat are induced to flow from one natural or artificial underground aquifer, which extends vertically, at an incline or horizontally, across a host-rock formation to a well. Alternatively, fluid and/or heat are induced to flow from a well across the host-rock formation to a natural or artificial aquifer. The aquifer and well constitute the polarities of a hydrologic cell, like the electrodes of a battery or electric cell. An aquifer can be formed by fracturing the host formation and by injecting proppants into the fracture. Fluid and/or heat is injected into the source of the hydrologic cell and is induced to flow across the hydrocarbon bearing host formation within the cell such that the displacement of the injected fluid or heat causes the hydrocarbon to flow into the sink of the hydrologic cell. Aquifer(s) or well(s) can serve as either the source or the sink of the hydrologic cell. At least one aquifer serves as one of the polarities of the hydrological cell.

20 Claims, 5 Drawing Sheets

HYDROLOGIC CELLS FOR THE EXPLOITATION OF HYDROCARBONS FROM CARBONACEOUS FORMATIONS

BACKGROUND OF THE INVENTION

1. Field of the Invention

The present invention relates in general to the recovery of hydrocarbons from underground geologic host formations such as oil reservoirs, oil shales, coal, tar sands and clathrates. The invention particularly relates to the use of hydrologic cells having polarities created by fluid driving forces directed between an aquifer and a well for extracting hydrocarbons from a host formation located between the polarities.

2. Description of Prior Developments

Hydrocarbons can be recovered from oil reservoirs, tar sands, and/or clathrates by drilling wells into the geologic formations surrounding the hydrocarbons. In the primary stages of hydrocarbon recovery, hydrocarbons can flow naturally from a drilled well. Hydrocarbons can also be made to flow out of such wells under the influence of pressurized fluids such as water, steam, or carbon dioxide injected via injection wells into the formations surrounding the hydrocarbons. Although these techniques adequately extract hydrocarbons, they are not particularly efficient or economical in every case.

Accordingly, a need exists for a system and method for more efficiently and more economically extracting hydrocarbons from carbonaceous host formations. A particular need exists for such a system and method which uses hydrologic cells for removal of hydrocarbons from carbonaceous host formations such as oil reservoirs, oil shales, coal and tar sands.

SUMMARY OF THE INVENTION

The present invention has been developed to fulfill the needs noted above and therefore has as an object the provision of a system and method for efficiently and economically extracting hydrocarbons from carbonaceous formations such as oil reservoirs, oil shales, tar sands, coal and the like.

Another object of the invention is the provision of a system and method for efficiently and economically extracting and exploiting hydrocarbons from carbonaceous formations through the use of a hydrologic cell.

Another object of the invention is the provision of a simple and efficient three dimensional hydrologic cell for extracting hydrocarbons wherein the hydrologic cell includes at least one natural or artificial aquifer.

Another object of the invention is the provision of a hydrologic cell requiring only one natural or artificial aquifer and which provides for the even flow of a fluid front through a host formation containing hydrocarbon.

Another object of the invention is the provision of a hydrologic cell for extracting hydrocarbons wherein one and only one polarity of the cell constitutes a natural or artificial aquifer.

These and other objects are met by the present invention which is directed to a system and method for removing and exploiting hydrocarbons held in carbonaceous host formations such as oil reservoirs, oil shales, tar sands, coal and clathrates. The system and method includes one or more hydrologic cells, each of which includes one aquifer serving as one polarity of each cell. The aquifer can serve as either a source or sink aquifer depending on the chosen polarity of the particular hydrologic cell. If the source is an aquifer, then the sink is a borehole and if the sink is an aquifer, then the source is a borehole.

The present invention has been developed as a refinement and improvement over copending U.S. patent application Ser. No. 08/936,150 filed Sep. 22, 1997 and titled Hydrologic Cells For Recovery Of Hydrocarbons Or Thermal Energy From Coal, Oil-Shale, Tar-Sands and Oil-Bearing Formations. This prior application, which is commonly owned with the present invention and is incorporated herein by reference, describes the use of a number of hydrologic cells which provides for the flow of fluid into a source aquifer and from there into host rocks containing hydrocarbons.

The hydrocarbon products held in the host formation (according to the prior application) can then be recovered by directing the hydrocarbons to flow through the host rock and into a sink aquifer. This system requires at least one source aquifer and at least one sink aquifer and a body of host rock or a carbonaceous host formation located between the source and sink aquifers. The source and sink aquifers are each independently connected to the surface by a series of boreholes drilled in the host formation.

The present invention seeks to simplify the dual aquifer system of the prior application by adapting a new and simplified arrangement of hydrologic cell polarities for creating an economical hydrologic cell. In this case, a hydrologic cell may be formed with at least one aquifer which can function as either a source or sink aquifer, depending on the desired polarity of the cell, but only one polarity of the cell is formed by an aquifer. The aquifer can be naturally occurring or artificially constructed such as by fracturing the host rock using a known technique referred to as "hydrofrac" and then by injecting proppants such as porous support materials into the fracture.

In order to remove the hydrocarbon from a host formation in accordance with the invention, fluid, heat or fluid and heat are induced to flow from one natural or artificial aquifer, across and through the host-rock formation and into a well. The aquifer can extend vertically, at an incline or horizontally.

Alternatively, fluid, heat or fluid and heat are induced to flow from a well, across and through a host-rock formation to a natural or artificial aquifer. For the purposes of the invention, the aquifers and wells constitute the polarities of a hydrologic cell like the electrodes of a battery or electric cell. Energy applied in the form of fluid pressure or heat provides the driving force across the hydrologic cell in a manner similar to the electrochemical potential which provides the electromotive force in a battery.

In the case where an aquifer is formed by fracturing the host formation and injecting proppants such as sand into the fracture, the resulting propped fracture can constitute the source of a hydrologic cell. Fluid, heat or fluid and heat is then injected into the source of the hydrologic cell and is induced to flow under pressure across and through the surrounding hydrocarbon-bearing host formation.

The displacement and movement of the injected fluid and/or heat through the host formation causes the hydrocarbon trapped in the host formation to flow into the sink of the hydrologic cell, which can take the form of a well. Either one or more aquifers or one or more wells can serve as either the source or the sink of the hydrologic cell.

A particularly significant feature of the invention is that at least one aquifer constitutes one of the polarities of a hydrologic cell used to extract hydrocarbons from a host formation.

An aquifer adapted for use in practicing the present invention can in some cases be formed by fluidizing tar or very viscous oil in the pore space of a host formation, with or without previously fracturing the host formation. An aquifer adapted for use in practicing the present invention can also be formed by fluidizing frozen methane (clathrate) located in the pore spaces of its host formation.

When the fluidized tar or clathrate is released and driven by injected fluid, commonly pressurized steam, across its host formation and extracted, the remaining host-rock deprived of tar or clathrate becomes porous and permeable and then can serve as an aquifer for forming a hydrologic cell in accordance with the present invention. Through the introduction of pressurized fluid and/or heat into the source of the hydrologic cell, the tar or clathrate in the host rock between the source and the sink of the cell can be induced to flow across the host rock into the sink of the hydrologic cell and can then be pumped out of well boreholes.

The present invention, which employs three dimensional hydrologic cells, can function efficiently and economically when compared to conventional enhanced hydrocarbon recovery techniques such as hydrofracturing, or water or steam flooding from borehole to borehole which do not use aquifers to form hydrologic cells. Hydrofracturing or "hydrofrac" has been used to increase the porosity and permeability of the host rock formations around a borehole so that hydrocarbon from the host rock around the borehole will flow to the surface through the borehole. Hydrofracturing can be used as an initial step in practicing the present invention by creating a fracture which can be converted into an aquifer.

With the current method of water or steam flooding, water or steam is injected into a host rock formation to provide a hydrodynamic driving force which moves hydrocarbon held in the host rock from one borehole into another and from there to the surface. This conventional approach forms a one-dimensional or two-dimensional hydrologic cell from borehole to borehole, and as such does not function particularly efficiently.

While the prior application (U.S. Ser. No. 08/936,950) makes use of three dimensional hydrologic cells in which fluid flows from a source aquifer to a sink aquifer, the use of a pair of aquifers can be costly. Nevertheless, the movement of injected fluid through such a three dimensional hydrologic cell has the advantage of efficiently sweeping out virtually all of the hydrocarbon held in the host formation, without leaving behind pockets of residual hydrocarbon located between the paths of injected fluid.

The present invention also makes efficient use of three dimensional hydrologic cells in which fluid flows from one or more source aquifers to one or more sink boreholes, or from one or more source boreholes to one or more sink aquifers. These three dimensional hydrologic cells are of the type in which only one polarity consists of one or more aquifers and the other polarity consists of one or more wells or boreholes.

Hydrologic cells requiring only one aquifer as a cell polarity as constructed in accordance with the invention, are more economical than hydrologic cells requiring two aquifers, particularly in those cases where the aquifers are created artificially as detailed in the prior application. By using only one aquifer, in accordance with the invention, the so-called "fingering effect" can be reduced. That is, the front or leading edge of the injected fluid moving through a carbonaceous host formation will move forwardly along an even line such that virtually no part of the fluid advances ahead of the general fluid front. When one portion of the fluid does move faster than the rest, along a most permeable path, a pattern resembling a finger protruding from a balled fist commonly results when prior extraction methods are employed. The present invention minimizes this undesirable possibility.

In addition to the enhanced recovery of hydrocarbon as described above, the present invention is also specifically applicable to the recovery of tar and clathrate (i.e. frozen methane). In order to appreciate the effectiveness of the present invention in these applications, a brief comment on conventional removal techniques may be useful.

Conventional techniques for the removal of hydrocarbons from tar include steam flooding from boreholes (which are commonly horizontally drilled) and the mining of tar sands for subsequent processing in factories. Conventional techniques of recovering clathrate or frozen methane from host rock formations include steam flooding from boreholes. These conventional techniques are either not very economical or are actually uneconomical.

While the prior application describes methods of exploiting tar sands with the construction of 3-dimensional hydrologic cells in which fluid flows from a source aquifer to a sink aquifer, these methods may not be the most economical, even though movement of injected fluid through such 3-dimensional hydrologic cells has the advantage of tending to sweep out all hydrocarbon in the host rock, without leaving pockets of hydrocarbon behind between the paths of injected fluid.

The present invention describes 3-dimensional hydrologic cells in which fluid flows from one or more source aquifers to one or more sink boreholes, or from one or more source boreholes to one or more sink aquifers. This fluid flow through 3-dimensional hydrologic cells of which only one polarity consists of aquifer(s) and the other polarity consists of well(s), is a major feature and advantage of the present invention.

Hydrologic cells requiring only one aquifer are more economic than hydrologic cells requiring two aquifers. The porosity and permeability of the host rock plugged by the presence of tar or frozen methane becomes porous and permeable when tar or frozen methane is fluidized and removed. The remaining host formation can then be used as an aquifer in the practice of the invention.

In further accordance with the invention, steam is injected into a horizontal fracture in the host rock of tar sand or of clathrate. The tar or frozen methane in the host rock is mobilized by the heat of the steam and is induced to flow into the sink of a hydrologic cell, which can either be a well or a sink-aquifer. Removed of the tar or clathrate from its pore space, the host rock becomes porous and permeable and can serve as the source aquifer of a hydrologic cell to receive injected steam. The steam can move either upward by pressure-drive or downward through gravity drainage to the sink of the hydrologic cell, which can be a borehole, or a sink aquifer.

Steam-injection into a hydrologic cell (SIHC) in accordance with the invention is both more economical in construction cost and more efficient in exploiting hydrocarbon from tar, as compared to the currently practiced steam-injection and gravity- drainage method (SAGD).

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

The present invention will now be described in conjunction with the drawings, beginning with FIG. 1*a* which schematically depicts an underground hydrologic cell 10 constructed in accordance with a first embodiment of the invention. In this example, the source of the hydrologic cell is an underground source aquifer 11, either naturally occurring or artificially constructed with hydrofracturing and proppants or other means. Fluid, as represented by the directional arrows 20, is pumped into aquifer 11 from the ground surface, for example, through boreholes 14. Although two boreholes 14 are shown, a minimum of one is required.

Figure 1B:
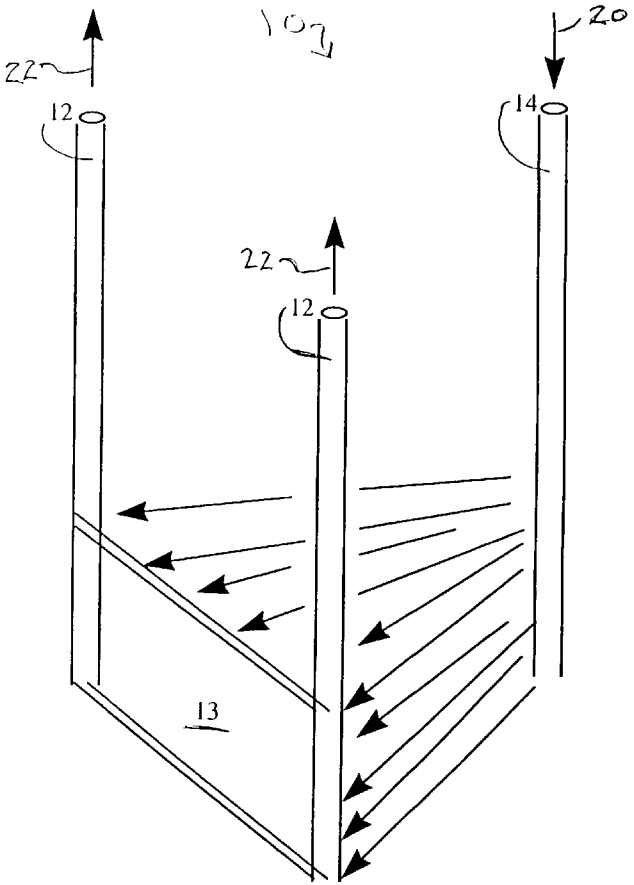
FIG. 1*b* is a schematic perspective view of another embodiment of the invention wherein the hydrologic cell polarities of FIG. 1 have been reversed.
Figure 1A:
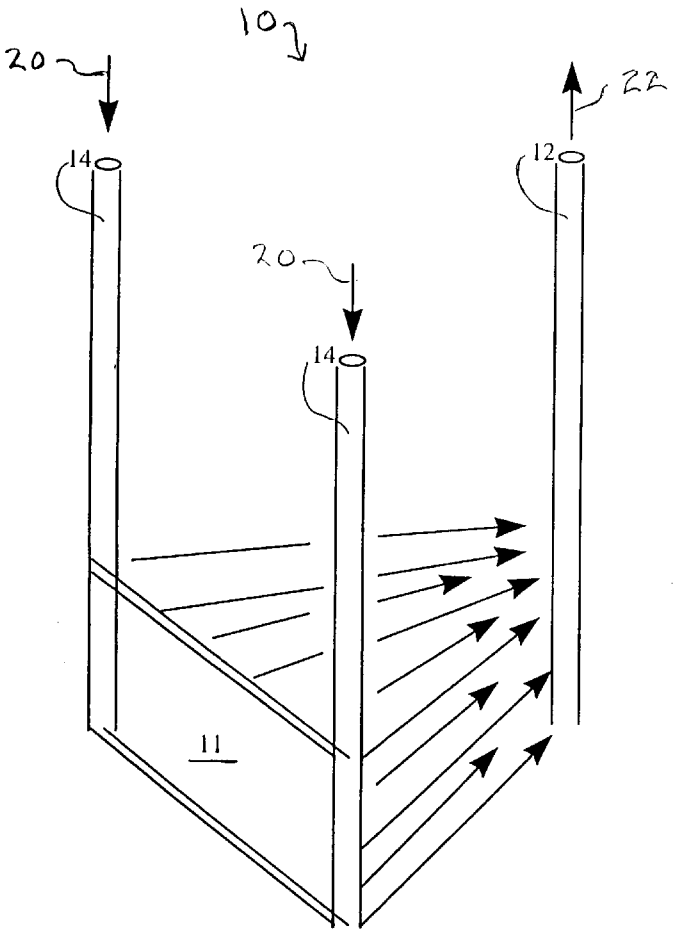
FIG. 1*a* is a schematic perspective view of a hydrologic cell constructed in accordance with a first embodiment of the invention.
Figure 2B:
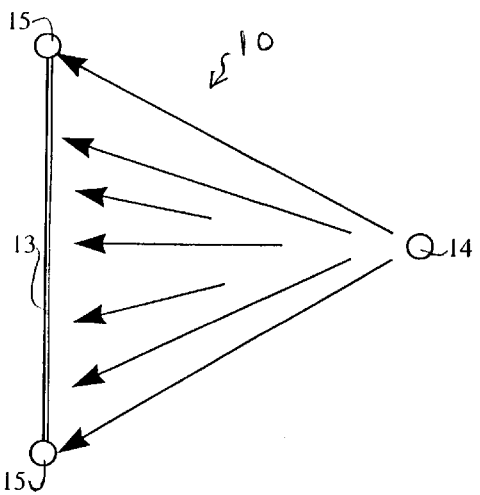
FIG. 2*b* is a top plan view of the hydrologic cell of FIG. 1*b;*
Figure 2A:
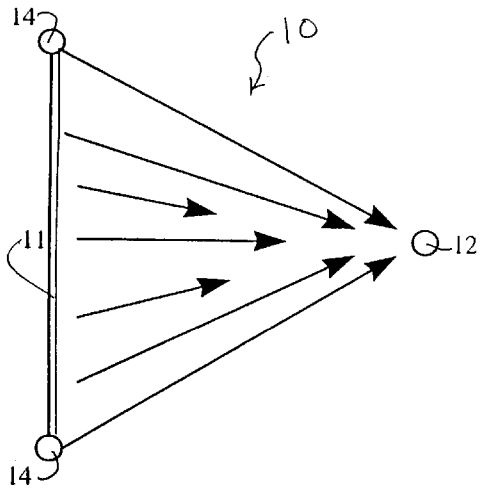
FIG. 2*a* is a top plan view of FIG. 1*a;*

The sink of the hydrologic cell 10 of FIG. 1*a* is a sink borehole 12 which in this case is a producing well from which hydrocarbons and/or hot gasses are pumped, extracted and removed to the ground surface for further processing, as represented by directional arrows 22. The direction of extraction fluid flow or thermal energy flow across and through the generally triangular shaped cell of FIG. 1*a* is represented in FIG. 2*a* by the directional arrows. This movement of fluid or heat across the cell drives the hydrocarbons held in the cell from the source to the sink.

In the example of FIG. 1*a*, aquifer 11 extends vertically between the two boreholes 14 and has a generally planar rectangular shape. The injection fluid 20 enters the aquifer from boreholes 14 and passes through the host formation thereby sweeping through a large 3-dimensional volume of host rock. Because the cell tapers and narrows from the source to the sink, the injected fluid front traveling through the cell remains even and avoids the "fingering" effect.

In FIG. 1*b*, the source of the hydrologic cell 10 is an injection borehole 14. The sink of the cell is a sink aquifer 13, from which hydrocarbon is pumped out of producing wells via sink boreholes 12. The flow of extracting fluid and hydrocarbons through the cell of FIG. 1*b* is shown in FIG. 2*b*. The cell in this example tapers or narrows from the sink towards the source. As the extracting fluid and hydrocarbons enter the porous sink aquifer 13, they flow freely to the sink boreholes 12 from which they are pumped to ground surface.

Figure 3B:
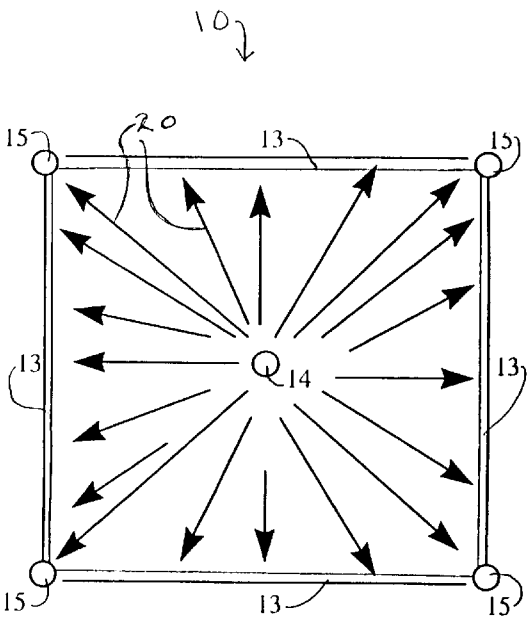
FIG. 3*b* is a top plan view of another hydrologic cell constructed in accordance with the invention having cell polarities reversed with respect to the cell of FIG. 3*a;*
Figure 3A:
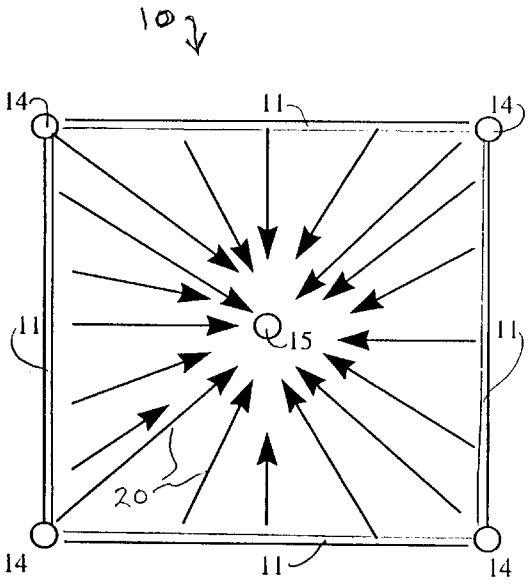
FIG. 3*a* is a top plan view of a hydrologic cell constructed in accordance with another embodiment of the invention.

Another embodiment of the invention is shown in FIG. 3*a* wherein a hydrologic cell 10 includes four source aquifers 11, four injection boreholes 14 through which extraction fluid is pumped and a single centrally located producing borehole 15 from which hydrocarbon is pumped to the ground surface. The source aquifers 11 extend vertically in planar fashion in the manner of side walls on a square box. Of course, the aquifer 11 can be arranged horizontally or at an incline, depending on the desired orientation of the cell 10.

In FIG. 3*b*, the hydrologic cell 10 is constructed from four sink aquifers 13 defining a rectangular or square cell as viewed in plan. Again, the aquifers extend vertically or outwardly orthogonal with respect to the plane of FIG. 3*b*. An injection borehole 14 is located in the center of the cell for injecting fluids through the cell. Hydrocarbons removed from the host formation by the injection fluid are pumped to the ground surface via producing boreholes 15 located at the corners or periphery of the cell. Each cell corner is defined by the intersection of a pair of aquifers 13.

Figure 4B:
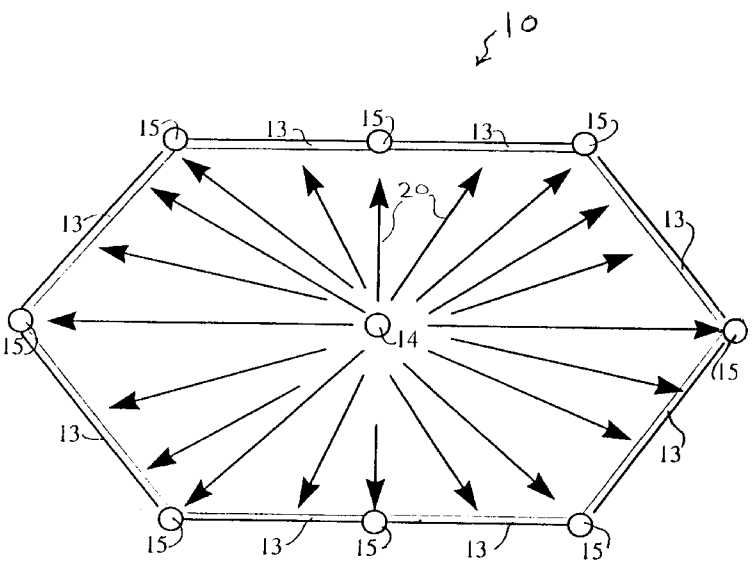
FIG. 4*b* is a top plan view of a polygonal hydrologic cell similar to FIG. 4*a* but with cell polarities reversed.
Figure 4A:
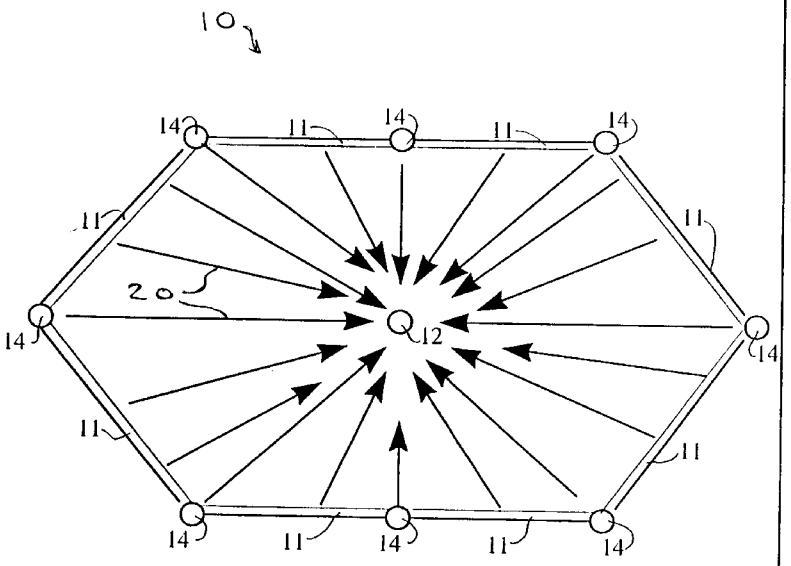
FIG. 4*a* is a top plan view of a polygonal hydrologic cell having a somewhat elliptical or round shaped perimeter and adapted for use with an underground hydrocarbon dome structure.

The polygonal cells 10 in FIGS. 4*a* and 4*b* are arranged to exploit and extract hydrocarbons from an underground dome structure which commonly has an oval or round perimeter. In FIG. 4*a*, numerous source aquifers 11 are defined along the perimeter of the dome structure and extend inwardly toward a central sink borehole 12 from which hydrocarbons are extracted. Fluid injection boreholes 14 are arranged in a generally elliptical pattern around the sink borehole 12 for injection of fluid through the aquifers 11 and into the central sink borehole 12.

The cell 10 of FIG. 4*b* reverses the cell polarity of FIG. 4*a* for the same purpose of extracting hydrocarbons from an underground dome structure. In this example, a single central source borehole 14 injects fluids outwardly across the dome structure toward sink aquifers 13. Production boreholes 15 are arranged around the perimeter of the dome structure to pump the hydrocarbons swept from the dome structure and collected by the sink aquifers up to the ground surface.

Figure 5B:
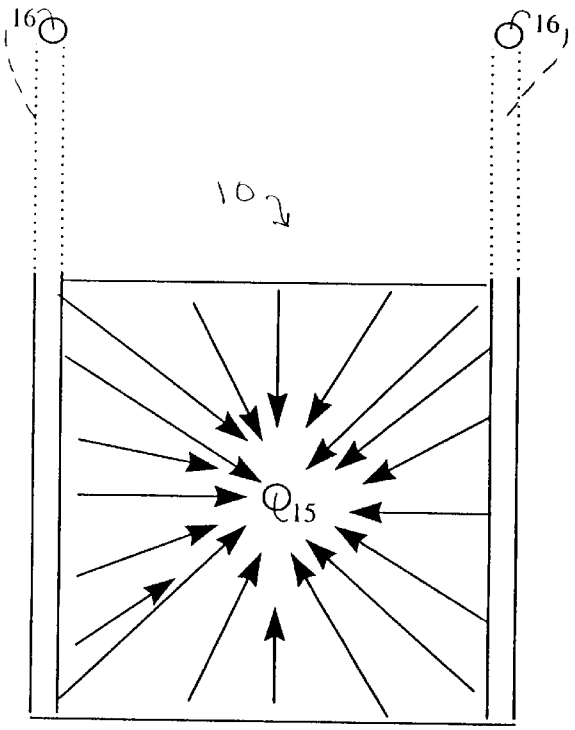
FIG. 5*b* is a top plan view of FIG. 5*a*.
Figure 5A:
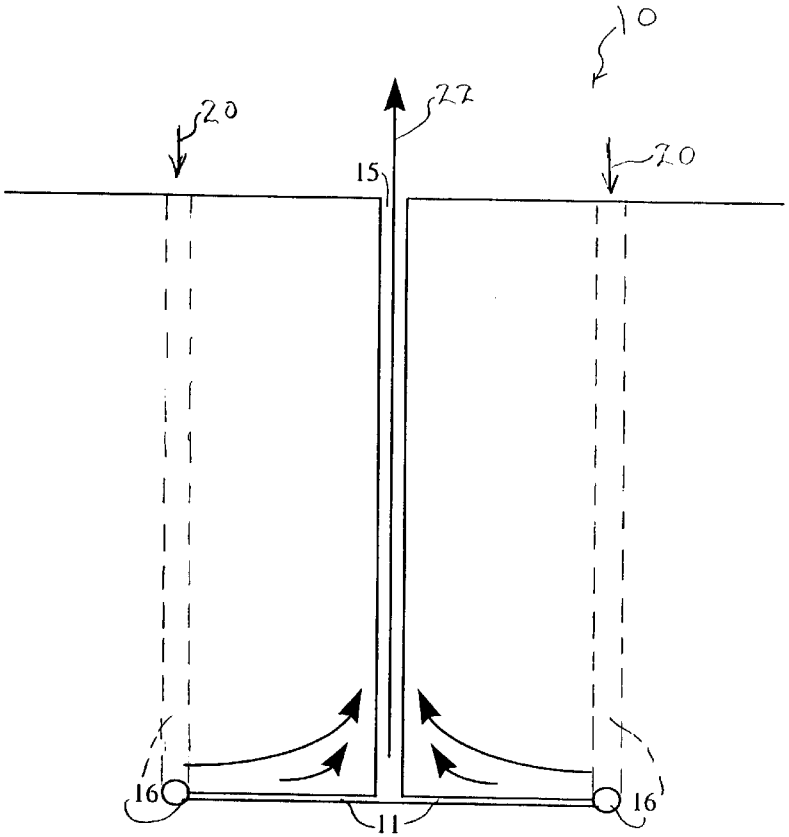
FIG. 5*a* is a schematic view in section showing another hydrologic cell constructed in accordance with the invention.

Another hydrologic cell arrangement is shown in FIGS. 5*a* and 5*b* wherein an artificial source aquifer 11 is formed between drilled wells 16. In this case, horizontally extending drilled wells 16 have vertically inclined portions represented by dashed lines. The source aquifer 11 can be formed by injecting proppants into a fracture adjacent the host formation or by fluidizing tar or frozen clathrate and extracting the tar or frozen clathrate from the host formation. The sink of this cell is formed by at least one borehole 15 from which hydrocarbon is produced and carried to ground surface. As seen in FIG. 5*b*, the cell 10 can be of rectangular or square shape when viewed in plan.

Gas in underground reservoirs will expand upon a relief of pressure. When an artificial aquifer, especially one that is horizontal, is inserted adjacent or above a gas reservoir such as by hydrofracturing and filling the fracture with proppants, the gas in the reservoir will expand and flow into the artificial aquifer, and from there into one or more pumping production wells penetrating into the artificial aquifer, in the manner shown in FIG. 5*a*. Since gas expansion is automatic, there is no need to inject fluid for enhanced gas recovery.

The hydrologic cell of fluid movement is from the gas reservoir to the artificial aquifer and then to production well(s).

There has been disclosed heretofore the best embodiment of the invention presently contemplated. However, it is to be understood that various changes and modifications may be made thereto without departing from the spirit of the invention.

What is claimed:

1. A system for the exploitation of hydrocarbons from an underground carbonaceous host formation comprising:

a hydrologic cell having a source and a sink and wherein at least one of said source and said sink comprises an aquifer and the other one of said source and said sink comprises a first borehole communicating with said ground surface, said host formation being located between said source and said sink; and boreholes or a second borehole communicating with said aquifer and communicating with said ground surface.

2. The system of claim 1, wherein said hydrologic cell comprises a three dimensional cell.

3. The system of claim 1, wherein said aquifer comprises a natural aquifer.

4. The system of claim 1, wherein said aquifer comprises an artificial aquifer.

5. The system of claim 4, wherein said aquifer comprises an underground fracture and proppants injected into said fracture.

6. The system of claim 1, wherein said aquifer comprises porous host rock and wherein pores in said host rock are formed by removal of hydrocarbon.

7. The system of claim 1, wherein said aquifer extends horizontally.

8. The system of claim 1, wherein said aquifer extends vertically.

9. The system of claim 1, wherein said aquifer extends at an angle between zero and 90 degrees with respect to said ground surface.

10. A system for the exploitation of hydrocarbons from an underground carbonaceous host formation comprising:

a hydrologic cell having a source and a sink and wherein at least one of said source and said sink comprises an aquifer and the other one of said source and said sink comprises a first borehole communicating with said ground surface, said host formation being located between said source and said sink, wherein said cell tapers and narrows from said source to said sink; and boreholes or a second borehole communicating with said aquifer and communicating with said around surface.

11. A system for the exploitation of hydrocarbons from an underground carbonaceous host formation comprising:

a hydrologic cell having a source and a sink and wherein at least one of said source and said sink comprises an aquifer and the other one of said source and said sink comprises a first borehole communicating with said ground surface, said host formation being located between said source and said sink, wherein said cell tapers and narrows from said sink to said source; and boreholes or a second borehole communicating with said aquifer and communicating with said ground surface.

12. A method of exploiting hydrocarbons held in host geologic formations using a hydrologic cell having a pair of polarities defined by a source and a sink and wherein one of said source and said sink comprises an aquifer and the other one of said source and said sink comprises a borehole, and wherein said method comprises:

locating said aquifer at one polarity of said hydrologic cell;

locating said borehole at the other polarity of said hydrologic cell;

injecting fluid into said cell through said source;

driving said hydrocarbon through said cell from said source to said sink with said fluid; and recovering said hydrocarbon from said sink.

13. The method of claim 12, wherein said fluid comprises water.

14. The method of claim 12, wherein said fluid comprises steam, or other fluid such as carbon-dioxide.

15. The method of claim 12, wherein said aquifer comprises a natural aquifer.

16. The method of claim 12, further comprising forming said aquifer by hydrofracturing.

17. The method of claim 12, further comprising forming said cell in the shape of an ellipse or a circle.

18. A method of exploiting hydrocarbons held in host geologic formations using a hydrologic cell having a pair of polarities defined by a source and a sink and wherein one of said source and said sink comprises an aquifer and the other one of said source and said sink comprises an aquifer and the other one of said source and said sink comprises a borehole, and wherein said method comprises;

locating said aquifer at one polarity of said hydrologic cell;

locating said borehole at the other polarity of said hydrologic cell;

injecting fluid into said cell through said source;

driving said hydrocarbon through said cell from said source to said sink with said fluid;

recovering said hydrocarbon from said sink; and forming said cell in the shape of a triangle.

19. A method of exploiting hydrocarbons held in host geologic formations using a hydrologic cell having a pair of polarities defined by a source and a sink and wherein one of said source and said sink comprises an aquifer and the other one of said source and said sink comprises an aquifer and the other one of said source and said sink comprises a borehole, and wherein said method comprises;

locating said aquifer at one polarity of said hydrologic cell;

locating said borehole at the other polarity of said hydrologic cell;

injecting fluid into said cell through said source;

driving said hydrocarbon through said cell from said source to said sink with said fluid;

recovering said hydrocarbon from said sink; and forming said cell in the shape of a polygon.

20. A method of extracting gas from an underground reservoir, comprising:

forming an artificial aquifer adjacent said reservoir such that gas from said reservoir flows into said artificial aquifer;

penetrating said artificial aquifer with a production well; and extracting said gas from said artificial aquifer with said production well.

* * * * *